US010486952B2

(12) United States Patent
Su

(10) Patent No.: US 10,486,952 B2
(45) Date of Patent: Nov. 26, 2019

(54) ANTI-SLIP HEAD OF PRY TOOL

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 126 days.

(21) Appl. No.: 15/785,461

(22) Filed: Oct. 17, 2017

(65) Prior Publication Data

US 2018/0127251 A1 May 10, 2018

(30) Foreign Application Priority Data

Nov. 7, 2016 (TW) ..... 105136153 A

(51) Int. Cl.
*B66F 19/00* (2006.01)
*B66F 15/00* (2006.01)

(52) U.S. Cl.
CPC ..... *B66F 15/00* (2013.01)

(58) Field of Classification Search
CPC ..... B66F 15/00; B66F 19/00
See application file for complete search history.

(56) References Cited

U.S. PATENT DOCUMENTS

| | | | | |
|---|---|---|---|---|
| 6,913,246 | B1 | 7/2005 | Skach | |
| 8,534,643 | B2 * | 9/2013 | Lombardi | B25G 1/10 254/21 |
| 8,914,929 | B2 * | 12/2014 | Hanlon | B25B 13/04 7/144 |
| 9,186,786 | B2 * | 11/2015 | Rosales | B25B 13/04 |
| D835,965 | S * | 12/2018 | Su | D8/89 |
| 2010/0038609 | A1 * | 2/2010 | Chen | B25D 1/04 254/26 R |
| 2010/0314593 | A1 | 12/2010 | Fan | |
| 2013/0126808 | A1 * | 5/2013 | Lombardi | B25G 1/10 254/26 R |
| 2016/0115007 | A1 | 4/2016 | Liou | |
| 2017/0051521 | A1 | 2/2017 | Bridges | |
| 2018/0127251 | A1 * | 5/2018 | Su | B66F 15/00 |

FOREIGN PATENT DOCUMENTS

| | | | |
|---|---|---|---|
| CN | 203842213 | U | 9/2014 |
| TW | M331454 | U | 5/2008 |
| TW | D157068 | S | 11/2013 |

* cited by examiner

*Primary Examiner* — Lee D Wilson
(74) *Attorney, Agent, or Firm* — Alan D. Kamrath; Karin L. Williams; Mayer & Williams PC

(57) ABSTRACT

A pry tool has an anti-slip head. The head has a body having a front end and a rear end and having first and second lateral sides and top and bottom sides extending from the front end to the rear end. The top and bottom sides connect the first and second lateral sides. The bottom side extends curvedly from the front end to the rear end. A partial area of the bottom side includes at least one first recess formed therein such that the bottom side has a rugged curved surface.

14 Claims, 5 Drawing Sheets

ANTI-SLIP HEAD OF PRY TOOL

BACKGROUND OF THE INVENTION

1. Field of the Invention

The present invention relates to a pry tool and, particularly, to a pry tool having a head that is prevented from slipping when the pry tool is in use.

2. Description of the Related Art

TW Pat. No. M331454 shows a pry tool has a handle and a head pivotally connected to the handle. The handle has two extensions each defining a hole and having teeth arranged around the hole. The head has a connecting end located between the two extensions. The connecting end defines a hole and have teeth arranged around the hole. A fastening device connects the head with the head with the handle. The fastening device engages with the hole of the connecting end of the head and the holes of the two extensions of the handle.

The head has a curved surface configured for abutment with a floor to provide a fulcrum. The head often slips off an object to be pried when a large levering force is applied to the pry tool.

The present invention is, therefore, intended to obviate or at least alleviate the problems encountered in the prior art.

SUMMARY OF THE INVENTION

According to the present invention, a pry tool has an anti-slip head. The head has a body having a front end and a rear end and having first and second lateral sides and top and bottom sides extending from the front end to the rear end. The top and bottom sides connect the first and second lateral sides. The bottom side extends curvedly from the front end to the rear end. A partial area of the bottom side includes at least one first recess formed therein such that the bottom side has a rugged curved surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
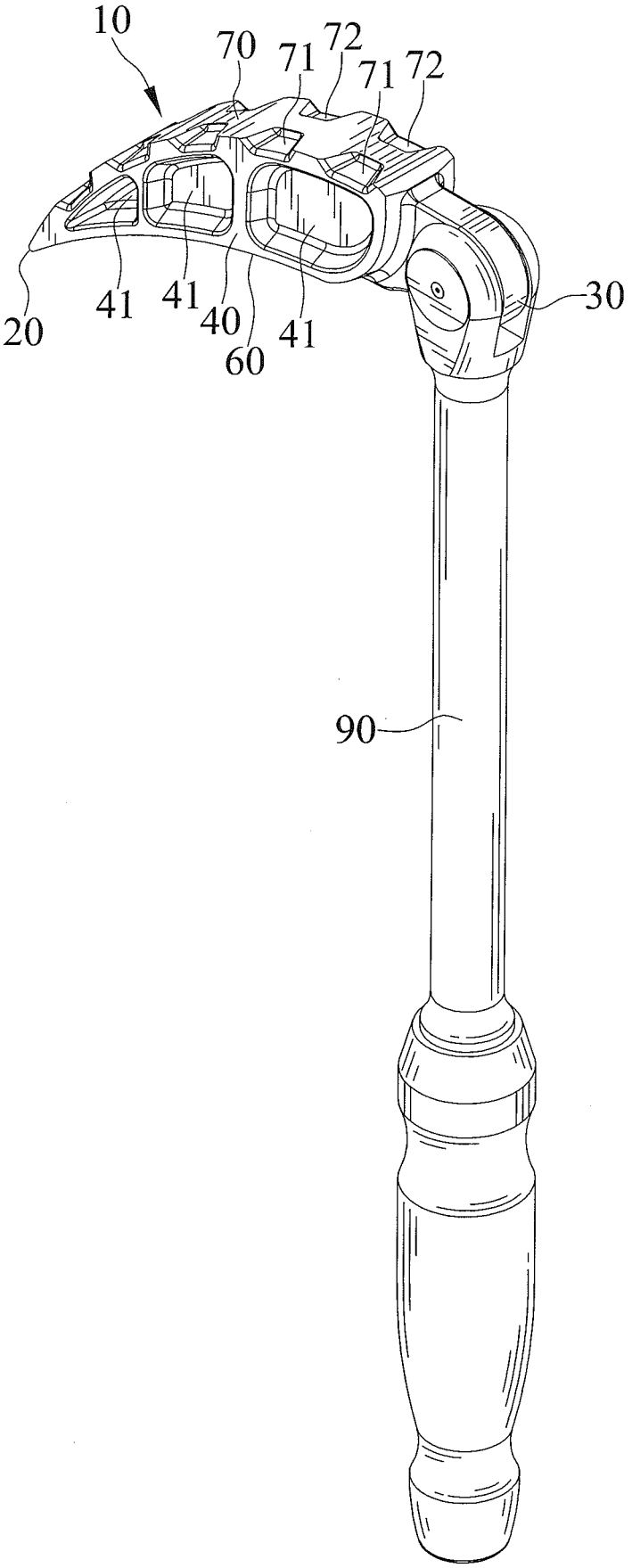
FIG. 1 is a perspective view of a pry tool having an anti-slip head in accordance with a first embodiment of the present invention.
Figure 2:
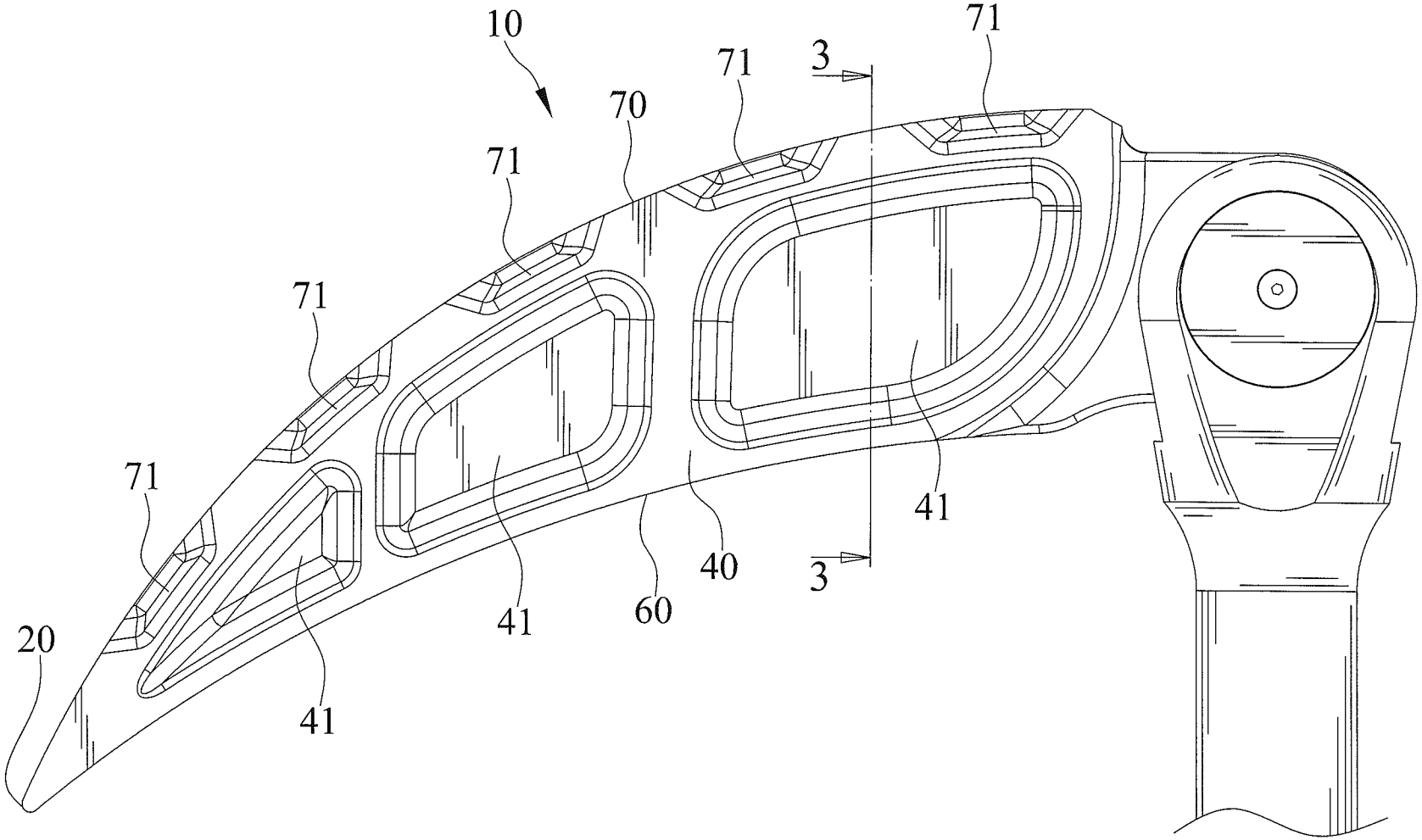
FIG. 2 is a side view of the anti-slip head shown in FIG. 1.
Figure 3:
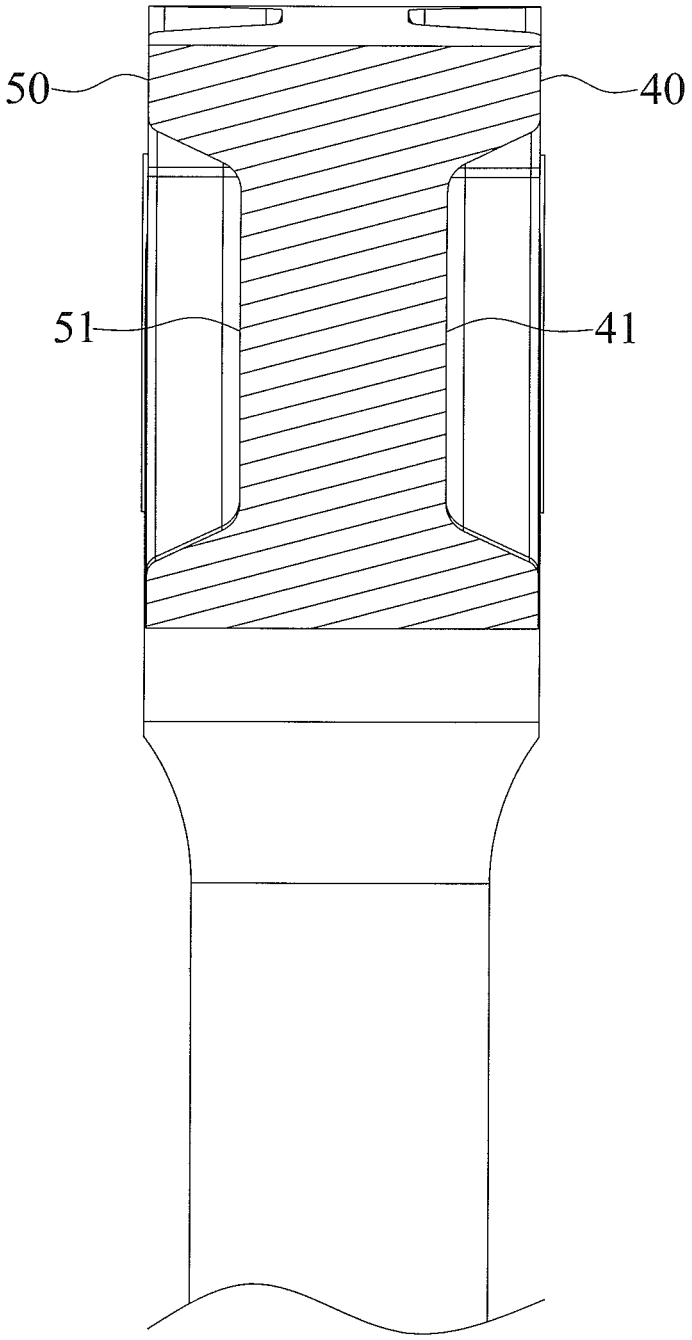
FIG. 3 is a cross-sectional view taken along line 3-3 of FIG. 2.
Figure 4:
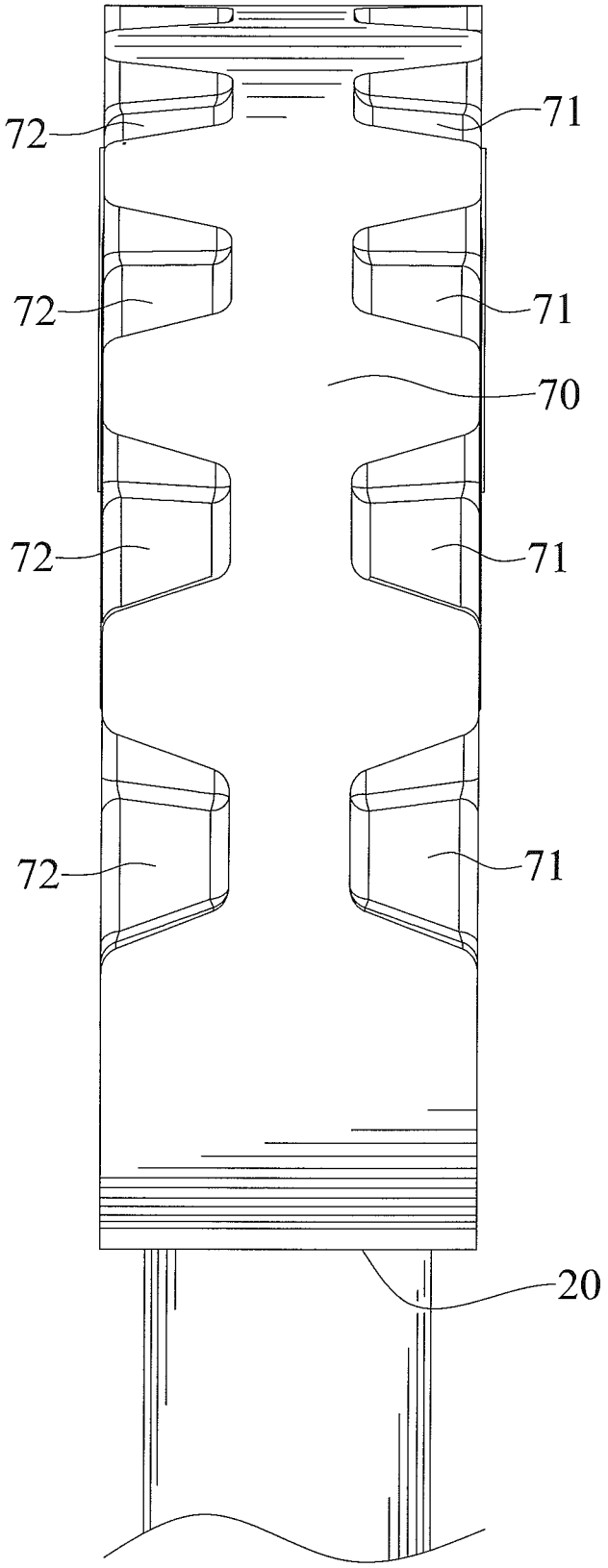
FIG. 4 is a top view of the anti-slip head shown in FIG. 1.

FIGS. 1 through 4 show a pry tool having an anti-slip head 10 in accordance with a first embodiment of the present invention and a handle 90. The anti-slip head 10 is pivotally connected to the handle 90. The anti-slip head 10 has a body having a front end 20 and a rear end 30 and having first and second lateral sides 40 and 50 and top and bottom sides 60 and 70 extending from the front end 20 to the rear end 30. The rear end 30 is opposite the front end 20 in a first direction. The first lateral side 40 is opposite the second lateral side 50 in a second direction transverse to the first direction. The top and bottom sides 60 and 70 extend in the second direction between the first and second lateral sides 40 and 50.

The first lateral side 40 defines at least one first cavity 41 for reducing the weight of the body. The at least one first cavity 41 has a first end and a second end and extends from the first end to the second end. The at least one first cavity 41 is open at the first end and has an opening through the one of the first and second lateral sides 40 and 50. The at least one first cavity 41 is closed at the second end and is disposed between the first and second lateral sides 40 and 50. The at least one first cavity 41 includes a plurality of first cavities 41 located separately from one another.

The second lateral side 50 defines at least one second cavity 51 for reducing the weight of the body too. The at least one second cavity 51 has a first end and a second end and extends from the first end to the second end. The at least one second cavity 51 is open at the first end and has an opening through another of the first and second lateral sides 40 and 50. The at least one second cavity 51 is closed at the second end and is disposed between the first and second lateral sides 40 and 50. The at least one first cavity 41 and the at least one second cavity 51 are located symmetrically about a center axis, which extends between the at least one first cavity 41 and the at least one second cavity 51. The at least one second cavity 51 includes a plurality of second cavities 51 located separately from one another.

The top and bottom sides 60 and 70 connect the first and second lateral sides 40 and 50. The bottom side 70 extends curvedly from the front end 20 to the rear end 30. A partial area of the bottom side 70 includes at least one first recess 71 formed therein such that the bottom side 70 has a rugged curved surface. The at least one first recess 71 has a first end and a second end and extends from the first end to the second end. The at least one first recess 71 is open at the first end and has an opening through the first lateral side 40. The at least one first recess 71 is closed at the second end and is disposed between the first and second lateral sides 40 and 50. The at least one first recess 71 has a first width between the first and second ends thereof. The at least one first recess 71 has a first depth smaller than the first width, with the first depth extending into the bottom side 70. The at least one first recess 71 includes a plurality of first recesses 71 located separately from one another.

The partial area of the bottom side 70 also includes at least one second recess 72 formed therein and located separately from the at least one first recess 71. The at least one second recess 72 has a first end and a second end and extends from the first end to the second end. The at least one second recess 72 is open at the first end and has an opening through the second lateral side 50. The at least one second recess 72 is closed at the second end and is disposed between the first and second lateral sides 40 and 50. The at least one second recess 72 has a second width between the first and second ends thereof. The sum of the first and second widths is greater than 0.5 times of a width between the first and second lateral sides 40 and 50. The at least one second recess 72 has a second depth smaller than the second width, with the second width extending into the bottom side 70. The at least one second recess 72 includes a plurality of second recesses 72 located separately from one another. Each of the plurality of first recesses 71 and each of the plurality of second recesses 72 are located symmetrically about the center axis, which also extends between the plurality of first recesses 71 and the plurality of second recesses 72.

The bottom side 70 is adapted to abut a floor. The bottom side 70 has a first end and a second end and the curved surface thereof extends from the first end to the second end, with the first end adjacent to the front end 20 of the body, with the second end adjacent to the rear end 30 of the body. The bottom side 70 has a first height at the first end and a second height at the second end with respect to the surface. The bottom side 70 increases in heights from the second end toward the first end.

Figure 5:
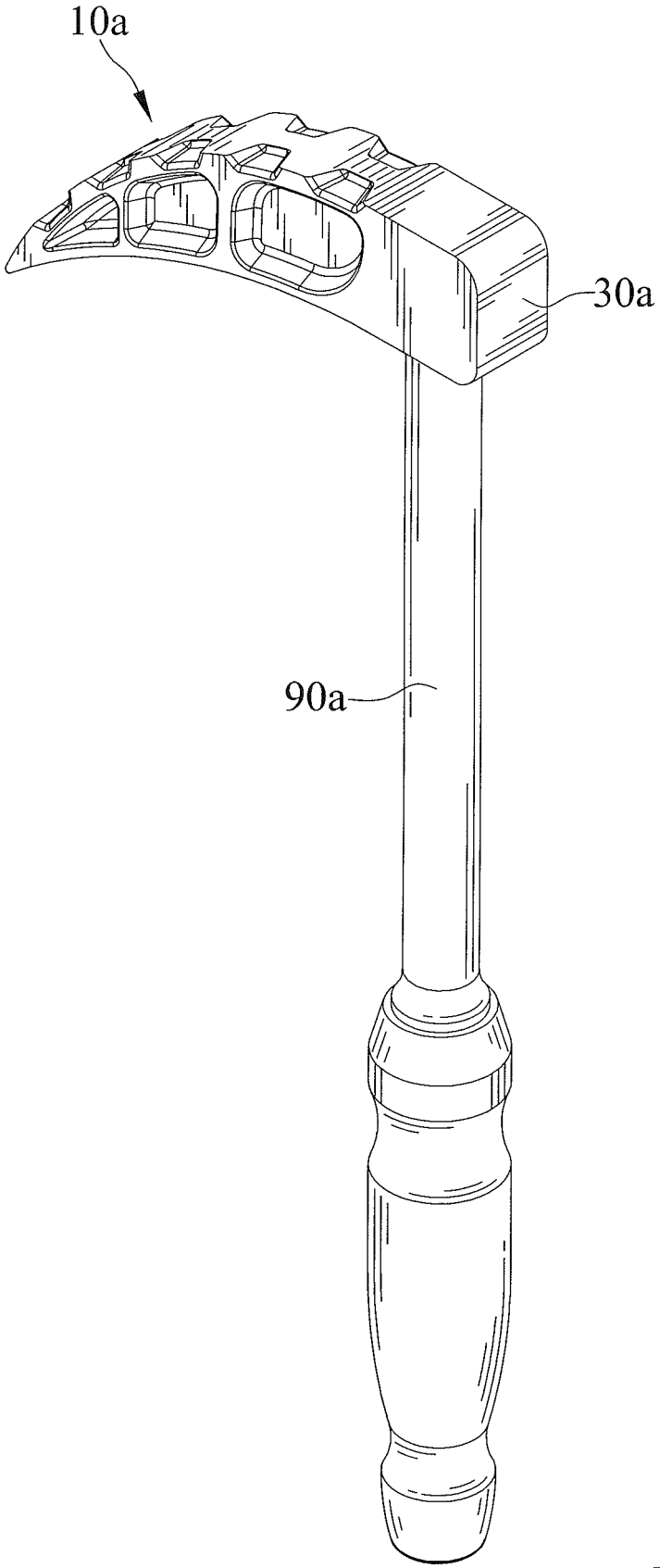
FIG. 5 is a perspective view of a pry tool having an anti-slip head in accordance with a second embodiment of the present invention.

FIG. 5 shows a pry tool having an anti-slip head 10*a* in accordance with a second embodiment of the present invention and a handle 90*a*, and the same numbers are used to correlate similar components of the first embodiment, but bearing a letter a. The anti-slip head 10*a* differentiates from the anti-slip head 10 in that the anti-slip head 10*a* is fixedly connected to the handle 90*a*. In addition, the anti-slip head 10*a* has a body defining an anvil surface. The anvil surface is located at a rear end 30*a* of the body.

In view of the foregoing, the bottom side 70 is a rugged curved surface. With the provision of the at least one first recess 71 and the at least one second recess 72 on the bottom side 70, the bottom side 70 is prevented from slip on the floor, even or uneven, when a large levering force is applied to the pry tool.

The foregoing is merely illustrative of the principles of this invention, and various modifications can be made by those skilled in the art without departing from the scope and spirit of the invention.

What is claimed is:

1. An anti-slip head of a pry tool comprising:

a body having a front end and a rear end and having first and second lateral sides and top and bottom sides extending from the front end to the rear end, with the top and bottom sides each connecting the first and second lateral sides, with the bottom side extending curvedly from the front end to the rear end, with the bottom side including at least one first recess and at least one second recess formed therein, thereby forming a rugged curved surface, and with the at least one first recess and the at least one second recess separated from each other;

wherein the at least one first recess extends from a first end to a second end and the first end is open and defines an opening through the first lateral side and the second end is closed and located between the first and the second lateral sides; and wherein the at least one second recess extends from a first end to a second end and the first end is open and defines an opening through the second lateral side and the second end is closed and disposed between the first and the second lateral sides.

2. The anti-slip head of the pry tool as claimed in claim 1, wherein the at least one first recess has a first width between the first and second ends thereof, wherein the at least one second recess has a second width between the first and second ends thereof, and wherein the sum of the first and second widths is greater than 0.5 times of a width between the first and second lateral sides.

3. The anti-slip head of the pry tool as claimed in claim 1, wherein the at least one first recess has a first width between the first and second ends thereof, and wherein the at least one first recess has a first depth smaller than the first width.

4. The anti-slip head of the pry tool as claimed in claim 3, wherein the at least one second recess has a second width between the first and second ends thereof, and wherein the at least one second recess has a second depth smaller than the second width.

5. The anti-slip head of the pry tool as claimed in claim 1, wherein the at least one first recess includes a plurality of first recesses located separately from one another, and wherein the at least one second recess includes a plurality of second recesses located separately from one another.

6. The anti-slip head of the pry tool as claimed in claim 1, wherein the bottom side is adapted to abut a floor, wherein the bottom side has a first end and a second end and the curved surface thereof extends from the first end to the second end, with the first end adjacent to the front end of the body, with the second end adjacent to the rear end of the body, wherein the bottom side has a first height at the first end and a second height at the second end with respect to the surface, and wherein the bottom side increases in heights from the second end toward the first end.

7. An anti-slip head of the pry tool comprising:

a body having a front end and a rear end and having first and second lateral sides and top and bottom sides extending from the front end to the rear end, with the top and the bottom sides connecting the first and second lateral sides, with the bottom side extending curvedly from the front end to the rear end, with a partial area of the bottom side including at least one first recess and at least one second recess formed therein, thereby forming a rugged curved surface, and with the at least one first recess and the at least one second recess separated from each other;

wherein the at least one first recess extends from a first end to a second end and the first end is open and defines an opening through the first lateral side and the second end is closed and located between the first and the second lateral sides; and wherein the at least one second recess extends from a first end to a second end and the first end is open and defines an opening through the second lateral side and the second end is closed and disposed between the first and the second lateral sides; and wherein the at least one first recess includes a plurality of first recesses located separately from one another and the at least one second recess includes a plurality of second recesses located separately from one another; and wherein each of the plurality of first recesses and each of the plurality of second recesses are located symmetrically about a center axis extending between the plurality of first recesses and the plurality of second recesses.

8. The anti-slip head of the pry tool as claimed in claim 7, wherein the at least one first recess has a first width between the first and second ends thereof, wherein the at least one first recess has a first depth smaller than the first width, wherein the at least one second recess has a second width between the first and second ends thereof, and wherein the at least one second recess has a second depth smaller than a second width.

9. The anti-slip head of the pry tool as claimed in claim 7, wherein the at least one first recess includes a plurality of first recesses located separately from one another, and wherein the at least one second recess includes a plurality of second recesses located separately from one another.

10. An anti-slip head of the pry tool comprising:

a body having a front end and a rear end and having first and second lateral sides and top and bottom sides extending from the front end to the rear end, with the top and the bottom sides connecting the first and second lateral sides, with the bottom side extending curvedly from the front end to the rear end, with a partial area of the bottom side including at least one first recess and at least one second recess formed therein, thereby forming a rugged curved surface, and with the at least one first recess and the at least one second recess separated from each other;

wherein the at least one first recess extends from a first end to a second end and the first end is open and defines an opening through the first lateral side and the second end is closed and located between the first and the second lateral sides; and wherein the at least one second recess extends from a first end to a second end and the first end is open and defines an opening through the second lateral side and the second end is closed and disposed between the first and the second lateral sides; and wherein the at least one first recess has a first width between the first and second ends thereof, wherein the at least one second recess has a second width between the first and second ends thereof, and wherein the sum of the first and second widths is greater than 0.5 times of a width between the first and second lateral sides; and wherein the at least one first recess has a first depth smaller than the first width, and wherein the at least one second recess has a second depth smaller than the second width; and wherein one of the first and second lateral sides defines at least one first cavity, wherein the at least one first cavity has a first end and a second end and extends from the first end to the second end, wherein the at least one first cavity is open at the first end and has an opening through the one of the first and second lateral sides, and wherein the at least one first cavity is closed at the second end and is disposed between the first and second lateral sides; and wherein another of the first and second lateral sides defines at least one second cavity, wherein the at least one second cavity has a first end and a second end and extends from the first end to the second end, wherein the at least one second cavity is open at the first end and has an opening through another of the first and second lateral sides, wherein the at least one second cavity is closed at the second end and is disposed between the first and second lateral sides, and wherein the at least one first cavity and the at least one second cavity are located symmetrically about the center axis.

11. The anti-slip head of the pry tool as claimed in claim 10, wherein the at least one first recess includes a plurality of first recesses located separately from one another, and wherein the at least one second recess includes a plurality of second recesses located separately from one another.

12. The anti-slip head of the pry tool as claimed in claim 10, wherein the at least one first recess has a first width between the first and second ends thereof, wherein the at least one first recess has a first depth smaller than the first width, wherein the at least one second recess has a second width between the first and second ends thereof, and wherein the at least one second recess has a second depth smaller than the second width.

13. The anti-slip head of the pry tool as claimed in claim 11, wherein each of the plurality of first recesses and each of the plurality of second recesses are located symmetrically about a center axis extending between the plurality of first recesses and the plurality of second recesses.

14. The anti-slip head of the pry tool as claimed in claim 10, wherein the at least one first cavity includes a plurality of first cavities located separately from one another and the at least one second cavity includes a plurality of second cavities located separately from one another.

* * * * *